US010145132B2

(12) United States Patent
Wagner

(10) Patent No.: US 10,145,132 B2
(45) Date of Patent: Dec. 4, 2018

(54) WALL PATCH SYSTEM AND METHOD

(71) Applicant: D.P. WAGNER MANUFACTURING, L.P., Houston, TX (US)

(72) Inventor: Alan Wagner, Houston, TX (US)

(73) Assignee: D.P. WAGNER MANUFACTURING, LLC, Hiram, GA (US)

( * ) Notice: Subject to any disclaimer, the term of this patent is extended or adjusted under 35 U.S.C. 154(b) by 0 days.

(21) Appl. No.: 15/495,030

(22) Filed: Apr. 24, 2017

(65) Prior Publication Data

US 2018/0305942 A1 Oct. 25, 2018

(51) Int. Cl.
*E04G 23/02* (2006.01)
*E04F 21/02* (2006.01)

(52) U.S. Cl.
CPC ..... *E04G 23/0203* (2013.01); *E04F 21/02* (2013.01); *Y10T 428/20* (2015.01)

(58) Field of Classification Search
CPC ..... E04G 23/0203; Y10T 428/20; E04F 21/02
USPC ..... 52/514, 514.5, 741.41, 742.13
See application file for complete search history.

(56) References Cited

U.S. PATENT DOCUMENTS 2,997,416 A * 8/1961 Helton ..... E04G 23/0203 156/391
3,325,955 A * 6/1967 Haut ..... E04F 21/02 428/63
3,373,467 A * 3/1968 Loughrey ..... F27D 1/16 114/227
3,583,122 A * 6/1971 Biegajski ..... E04G 23/0203 428/63
3,690,084 A * 9/1972 Leblanc ..... E04G 23/0203 428/63
3,713,200 A * 1/1973 Burns ..... H05K 13/0007 225/103
3,874,505 A * 4/1975 Mirarchi ..... E04G 23/0203 206/231
4,075,809 A * 2/1978 Sirkin ..... E04G 23/0203 52/514
4,193,243 A * 3/1980 Tiner ..... E04G 23/0203 156/98
4,285,183 A * 8/1981 Condit ..... E04G 23/0203 52/514
4,335,554 A * 6/1982 Nicholson ..... E04G 23/0203 52/514
4,848,056 A * 7/1989 Kelly ..... E04G 23/02 52/514
5,018,331 A * 5/1991 Forzano ..... E04G 23/0203 52/514
5,033,949 A * 7/1991 Jewett ..... E04G 23/0203 264/30

(Continued)

*Primary Examiner* — Adriana Figueroa
*Assistant Examiner* — Jessie T Fonseca
(74) *Attorney, Agent, or Firm* — Barnes & Thornburg LLP; Jason Bernstein

(57) ABSTRACT

Applicant has created an apparatus for patching a hole in a wall. The apparatus preferably comprises a multi-section backer plate and a setting or installation tool. The backer plate comprises three rotatably joined sections, together presenting a face that is adhered to an inner wall of the hole, thereby supporting a filler material to fill the hole. The hinges allow the left and right sections to fold forward but not rearward of the planar surface of the middle section. The plate and tool are configured to permit the tool to be selectively joined to the plate at multiple locations along the plate.

18 Claims, 22 Drawing Sheets

(56) References Cited

U.S. PATENT DOCUMENTS

| | | | | | |
|---|---|---|---|---|---|
| 5,269,861 | A * | 12/1993 | Gilbreath | E04G 23/0203 | 156/71 |
| 5,778,624 | A * | 7/1998 | Russell | E04G 23/0203 | 52/514 |
| 5,960,603 | A * | 10/1999 | Redden | E04G 23/0203 | 52/514 |
| 5,983,587 | A * | 11/1999 | Limonad | E04G 23/0203 | 52/514 |
| 6,378,263 | B1 * | 4/2002 | Sobers | E04G 23/0203 | 52/443 |
| 2006/0010816 | A1 * | 1/2006 | Patrick | E04G 23/0203 | 52/514 |
| 2006/0101765 | A1 * | 5/2006 | Bailey | E04G 23/0203 | 52/514 |
| 2006/0123728 | A1 * | 6/2006 | Clark | E04G 23/0203 | 52/514 |
| 2009/0084062 | A1 * | 4/2009 | Riggs | E04G 23/0203 | 52/741.4 |
| 2011/0107705 | A1 * | 5/2011 | Georgievski | E04G 23/0203 | 52/514 |
| 2013/0312362 | A1 * | 11/2013 | Maanum | F16K 3/03 | 52/742.13 |
| 2017/0107729 | A1 * | 4/2017 | Wang | E04G 23/0207 | |

* cited by examiner

WALL PATCH SYSTEM AND METHOD

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to systems and methods for patching a hole in a wall.

Description of the Related Art

There are known systems for patching a hole in a wall.

For example, there is a system that comprises adhering a screen material to an outer-finished surface of the wall, covering the hole. A putty is then applied to the screen and paint is applied to conceal the hole.

Although these prior art solutions can be effective, there are several drawbacks to them as well. For example, the prior art technique does not provide adequate support and leaves a raised surface over the hole.

BRIEF SUMMARY OF THE INVENTION

The objects described above and other advantages and features of the invention are incorporated in the application as set forth herein, and the associated appendices and drawings.

Applicant has created an apparatus for patching a hole in a wall. The apparatus preferably comprises a multi-section backer plate and a setting or installation tool.

In at least one embodiment, the backer plate comprises a left section, a right section, and a middle section presenting a forward facing planar surface, the three sections together presenting a face co-planar with the planar surface of the middle section. The backer plate also preferably includes an adhesive along four sides of the face of the backer plate to bond the plate to an inner surface of the wall, thereby providing support for a filler material to fill the hole.

The sections are preferably joined with integrally molded hinges rotatably connecting the middle section to the left section and the right section. The hinges allow the left and right sections to fold forward but not rearward of the planar surface of the middle section. Each section comprises a plurality of substantially parallel rigid spines, a plurality of substantially parallel rigid ribs, with the ribs being aligned at right angles to the spines, and elongated openings between the spines and ribs, the openings including a web therein.

The plate and tool are configured to permit the tool to be selectively joined to the plate at multiple locations along the plate. As such, the tool preferably comprises a t-handle and a fitting opposite the t-handle. The fitting includes an elongated distal component configured to fit through the openings, displacing the web, in a first orientation but not a second orientation.

BRIEF DESCRIPTION OF THE SEVERAL VIEWS OF THE DRAWINGS

The following figures form part of the present specification and are included to further demonstrate certain aspects of the present disclosure. The disclosure may be better understood by reference to one or more of these figures in combination with the detailed description of specific embodiments presented herein.

Figure 1:
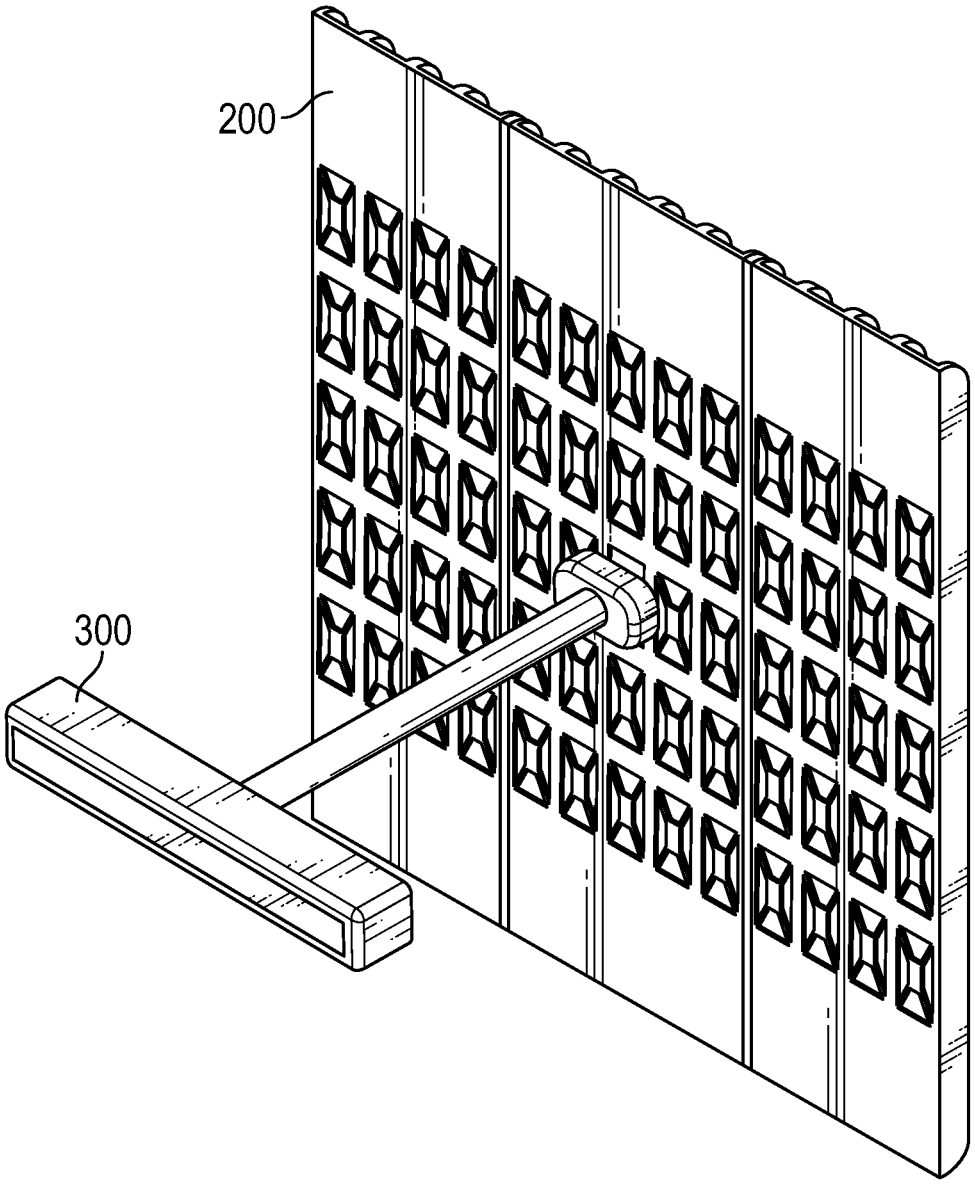
FIGS. 1-3 show a perspective, plan, and elevation view, respectively, of certain aspects of a wall patch system in accordance with the present disclosure.

While the inventions disclosed herein are susceptible to various modifications and alternative forms, only a few specific embodiments have been shown by way of example in the drawings and are described in detail below. The Figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION OF THE INVENTION

The Figures described above and the written description of specific structures and functions below are not presented to limit the scope of what Applicant has invented or the scope of the appended claims. Rather, the Figures and written description are provided to teach any person skilled in the art to make and use the invention for which patent protection is sought.

Those skilled in the art will appreciate that not all features of a commercial embodiment of the invention are described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally forming one functional member with another in a unity fashion. The coupling can occur in any direction, including rotationally. The term "substantially parallel," as used throughout the disclosure, can be defined as an angle that deviates no more than ten degrees from a parallel configuration.

Figure 2:
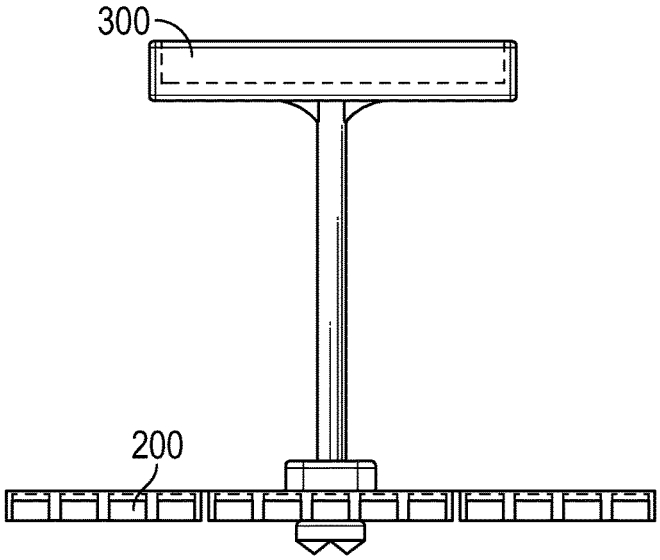
Figure 3:
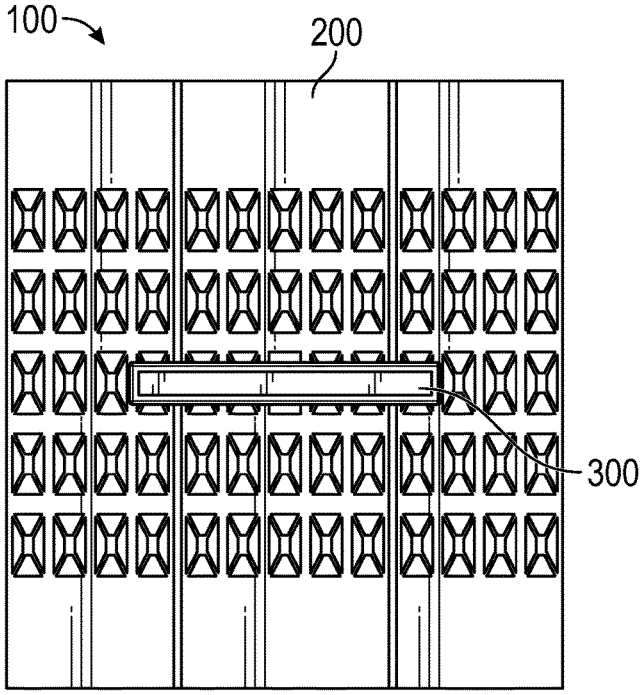
Figure 4:
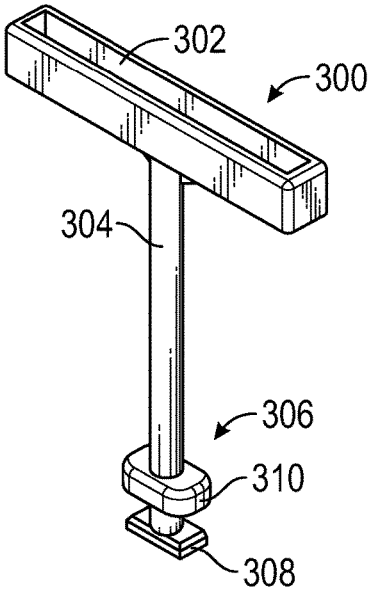
FIGS. 4-7 show a perspective, side, plan, and elevation view, respectively, of certain aspects of a tool of the wall patch system in accordance with the present disclosure.

Turning to the drawings and, in particular to FIGS. 1-3 an apparatus 100 for patching a hole in a wall is shown. As shown, the apparatus 100 comprises a multi-section backer plate 200 and a setting tool 300.

Figure 5:
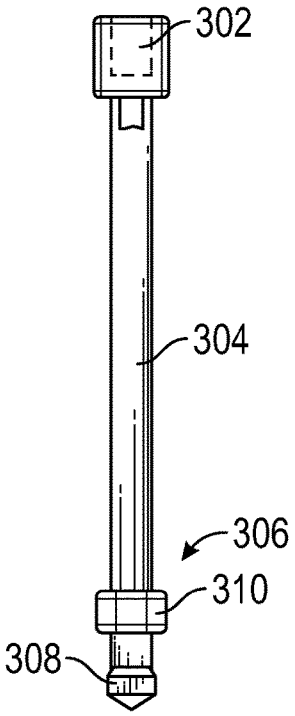
Figure 6:
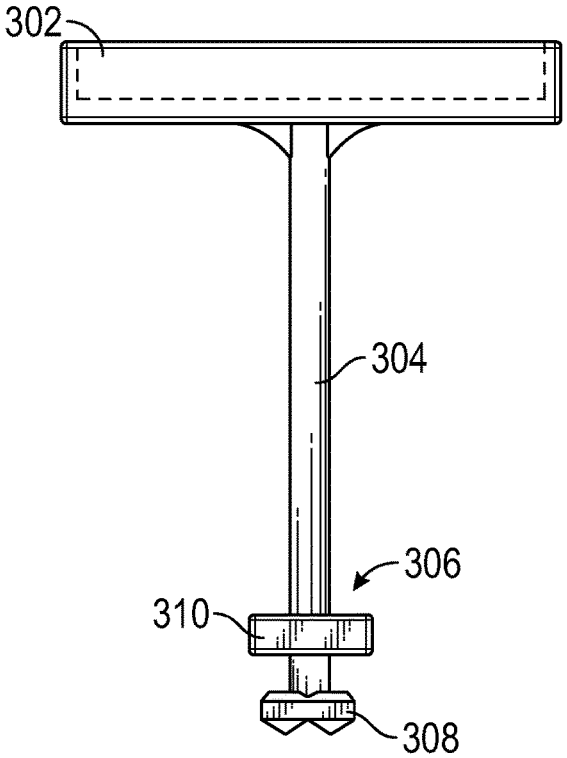
Figure 7:
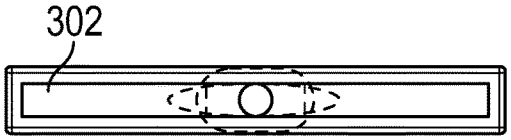

Turning to FIGS. 4-7, the setting tool 300 is shown in more detail. In the embodiment shown, the tool 300 comprises a T-handle 302, a shaft 304 extending from a middle portion of the T-handle 302 and a fitting 306 at a distal end of the shaft 304, opposite the T-handle 302. As best shown in FIGS. 5 and 6, the fitting 306 includes a distal component 308 furthest from the handle 302 and a proximal component 310 closer to the handle 302. The shaft 304 may run between the distal component 308 and proximal component 310 of the fitting 306, or the fitting 306 itself may include a spacer element to separate the distal component 308 and proximal component 310.

Figure 8:
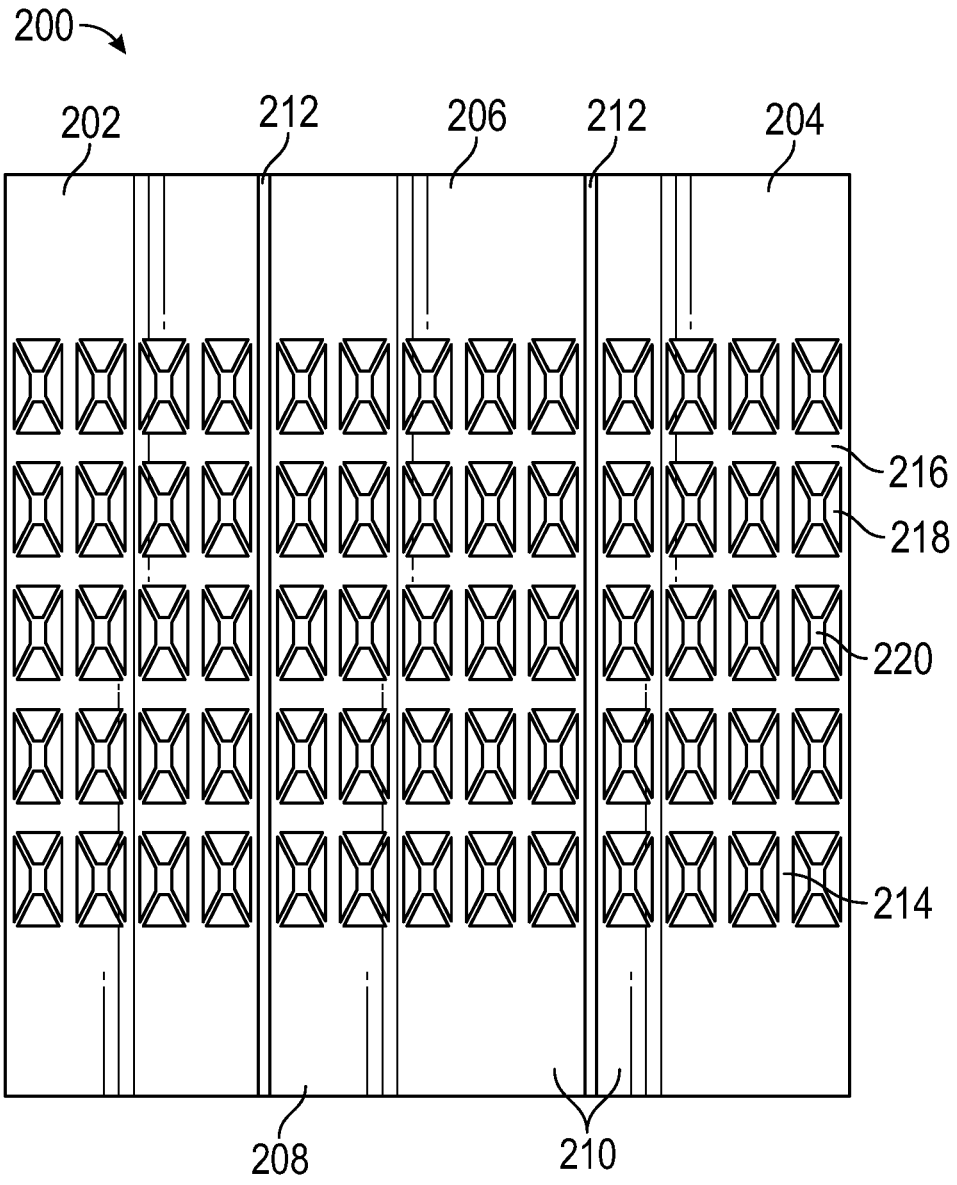
FIGS. 8 and 9 show a front and rear elevation view, respectively, of a backer plate of the wall patch system in accordance with the present disclosure.
Figure 9:
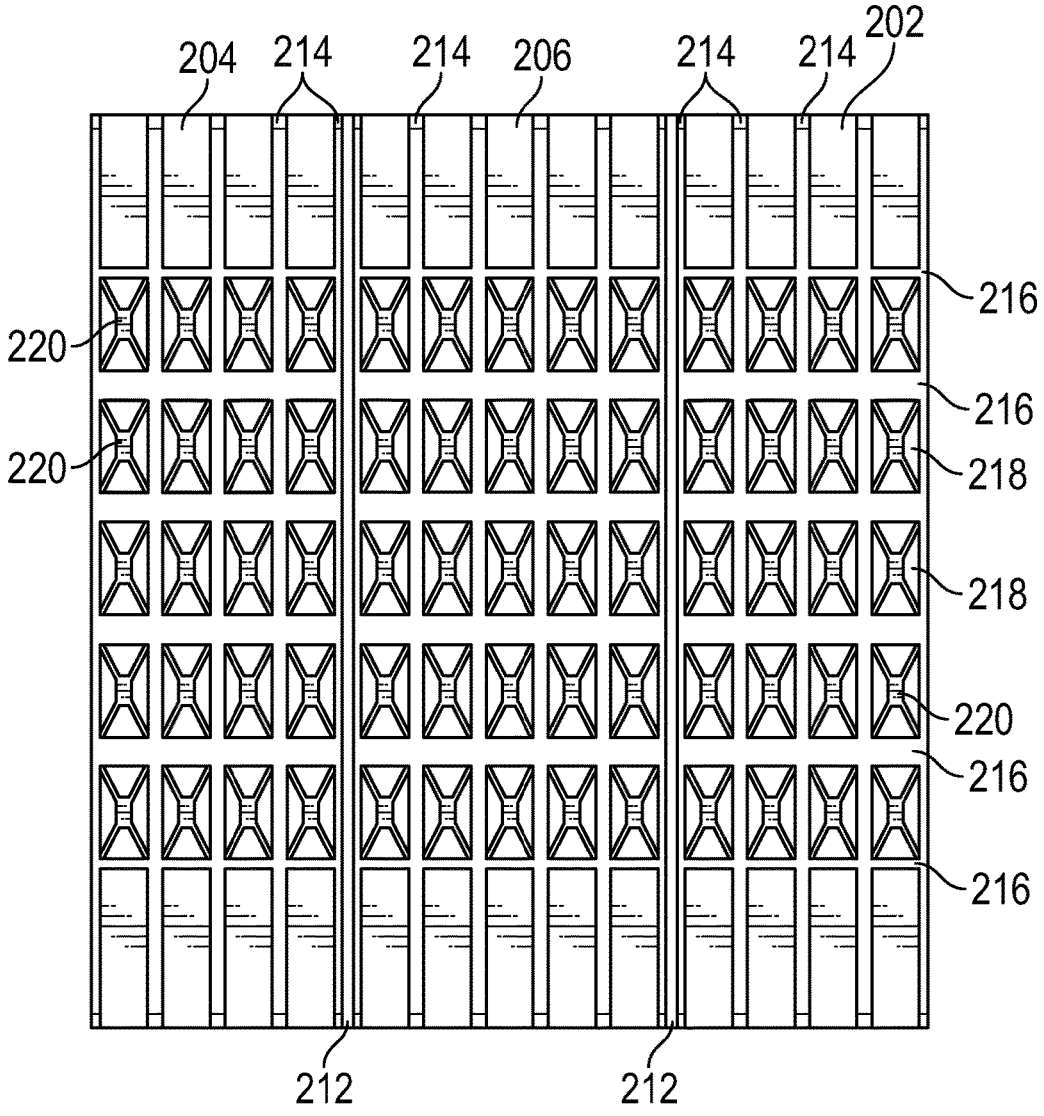

Referring to FIGS. 8 and 9, the multi-section backer plate 200 preferably comprises a left section 202, a right section 204, and a middle section 206. The middle section presents a forward facing planar surface 208. The three sections together presenting a face 210 which is preferably co-planar with the planar surface 208 of the middle section 206. As shown, the middle section 206 is connected to the left and right sections 202,204 with first and second integrally molded hinges 212. In other words, the integrally molded hinges 212 rotatably connect the middle section 206 to the left section 202 and the right section 204. As shown, the hinges 212 allow the left and right sections 202,204 to fold forward but not rearward of the planar surface 208 of the middle section 206.

More specifically, as best shown in FIG. 9, each section 202,204,206 includes a number of rigid spines 214 and rigid ribs 216. As shown, the spines 214 are parallel, with each other, as are the ribs 216. It can also be seen that the ribs 216 are aligned at right angles to the spines 214. While other alignment schemes may be possible, it has been discovered that the alignment scheme shown provides rigidity along the face 210 of the backer plate 200, save for the rotatability along the hinges 212.

For example, the hinges 212 may cooperate with one of more of the spines 214 to permit the left and right sections 202,204 to fold forward but not rearward of the planar surface 208 of the middle section 206, as discussed above. More specifically, as shown in FIG. 9, the hinges 212 may be aligned between two spines 214, or in the center of a spine 214, to permit the left and right sections 202,204 to fold forward, away from the spines 214. The spine(s) 214 would contact and therefore not permit the left and right sections 202,204 to fold rearward of the planar surface 208 of the middle section 206.

It can be seen that there are openings 218 between the spines 214, and the ribs 216 of the sections 202,204,206. These openings 218 are preferably elongated. In the preferred embodiment shown, the openings 218 are rectangular, but may be oval or another shape, the function of which will become apparent upon further reading of this disclosure. It can also be seen that these openings 218 are preferably spanned by a web structure 220. In any case, as shown, the backer plate 200, including the sections 202,204,206, the hinges 212, the spines 214, the ribs 216, and the webs 220 are preferably integrally molded as a single unitary continuous structure.

Figure 10:
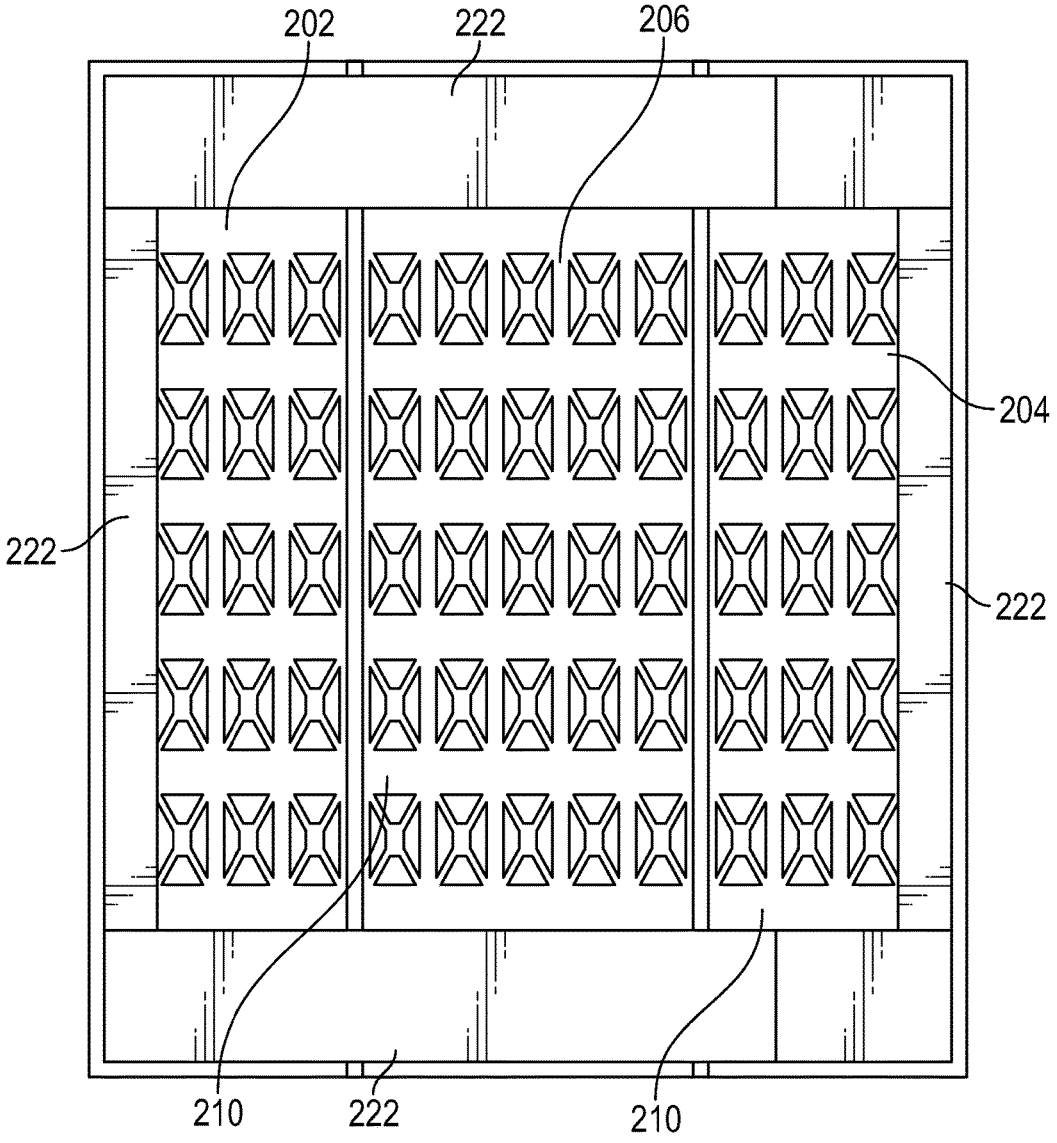
FIGS. 10 and 11 show a front elevation and a perspective view of certain aspects of the wall patch system in accordance with the present disclosure.

Referring also to FIG. 10, the backer plate 200 preferably includes an adhesive 222 applied to the face 210 of the backer plate 200. As shown, the adhesive 222 is preferably applied to the periphery of the face 210 of the backer plate 200. For example, the adhesive 222 may be applied to all four sides of the face 210 of the backer plate 200. Alternatively, the adhesive 222 may be applied to only two sides of the face 210 of the backer plate 200, such as the top and bottom spanning all three sections of the backer plate 200. In the embodiment shown, the adhesive 222 is a double sided tape, but may comprise a glue or other adhesive.

Figure 11:
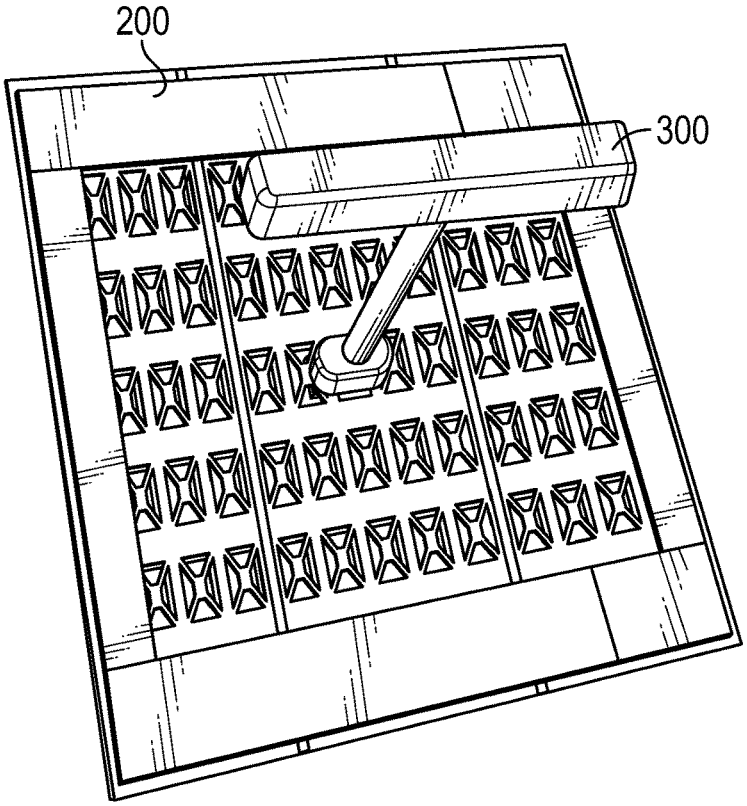
Figure 12:
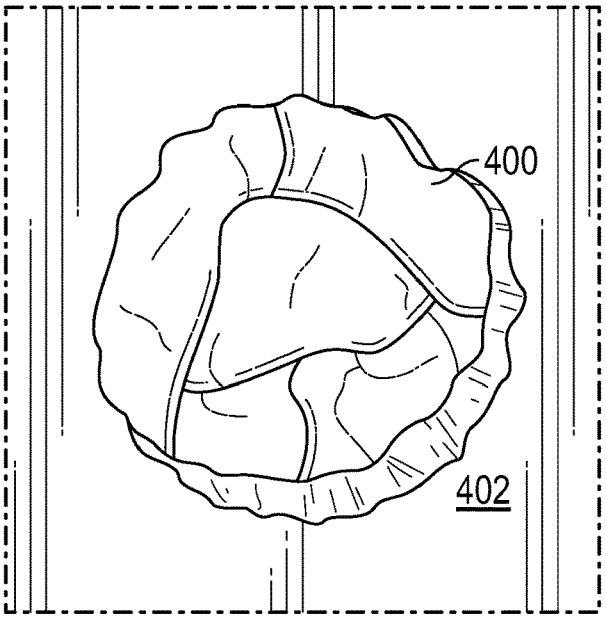
FIGS. 12-26 show a method of patching a hole in a wall in accordance with the present disclosure.

As shown in FIG. 11, the backer plate 200 and the tool 300 are configured to permit the tool 300 to be selectively joined to the plate 200 at multiple locations along the plate 200. Specifically, the fitting 306 of the tool 300 is designed to fit into any of the openings 218, displacing the webs 220, in a first orientation but not a second orientation. For example, the distal component 308 of the fitting 306 is preferably elongated in complementary fashion to the openings 218 in the plate 200, such that the distal component 308 may fit through any of the openings 218 in one orientation, and be rotated to another orientation in which the distal component 308 does not fit through the opening 218, thereby joining the tool 300 to the plate 200. To aid in inserting the fitting 306 into the opening 218, and displacing the web 220, the distal component 308 of the fitting 306 may be angled or pointed, as shown in FIGS. 5 and 6. The proximal component 310 of the fitting 306 is preferably sized and configured to prevent over insertion of the fitting 306 into the openings 218, in any orientation, and is therefore preferably larger than the distal component 308 and/or the openings 218.

Figure 13:
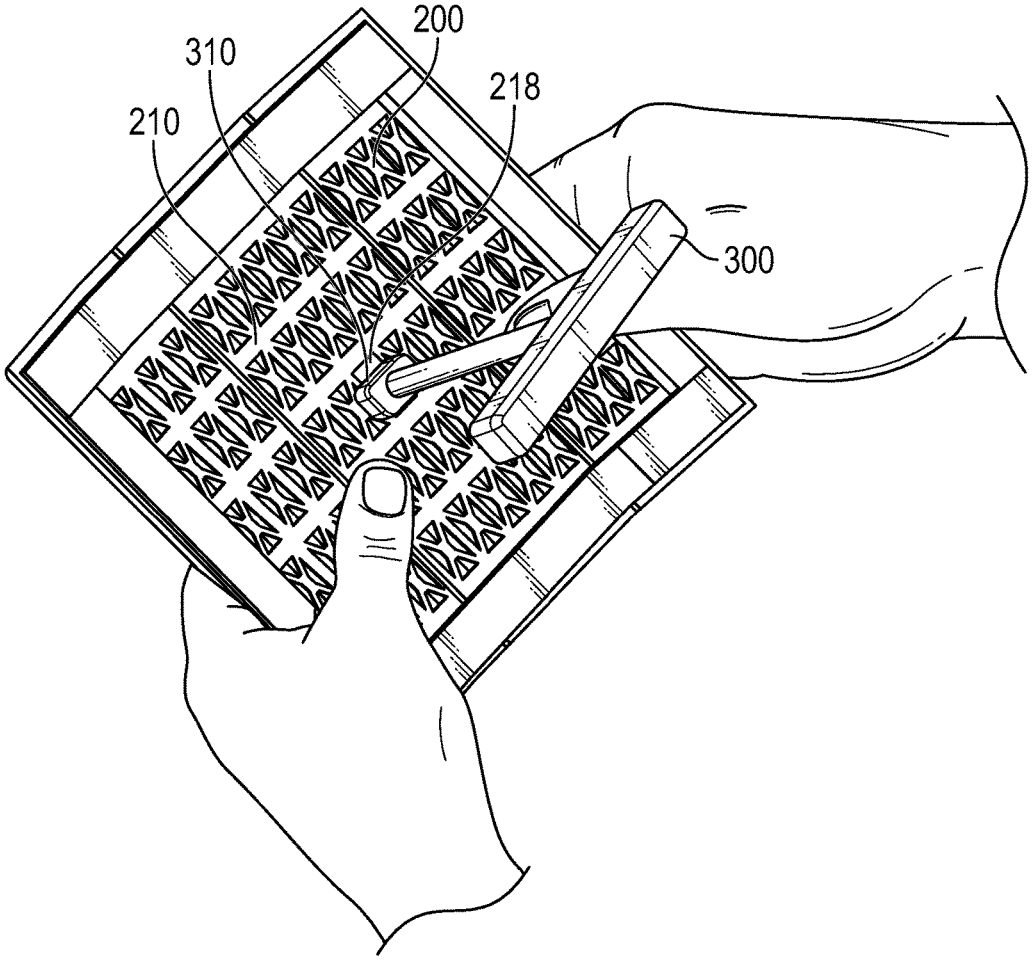

In use, referring also to FIGS. 12-26, the apparatus 100 is especially useful for patching a hole 400 in a wall 402. As shown in FIG. 13, a user preferably joins the tool 300 to the plate 200 by pressing the distal component 308 of the fitting 306 through an opening 218 near the center of the face 210 of the backer plate 200. In doing so, the distal component 308 of the fitting 306 displaces the web 220 in the opening 218. The user then rotates the tool 300 approximately ninety degrees to capture the plate 200 between the distal component 308 and proximal component 310 of the fitting 306, thereby joining the tool 300 to the plate 200.

Figure 14:
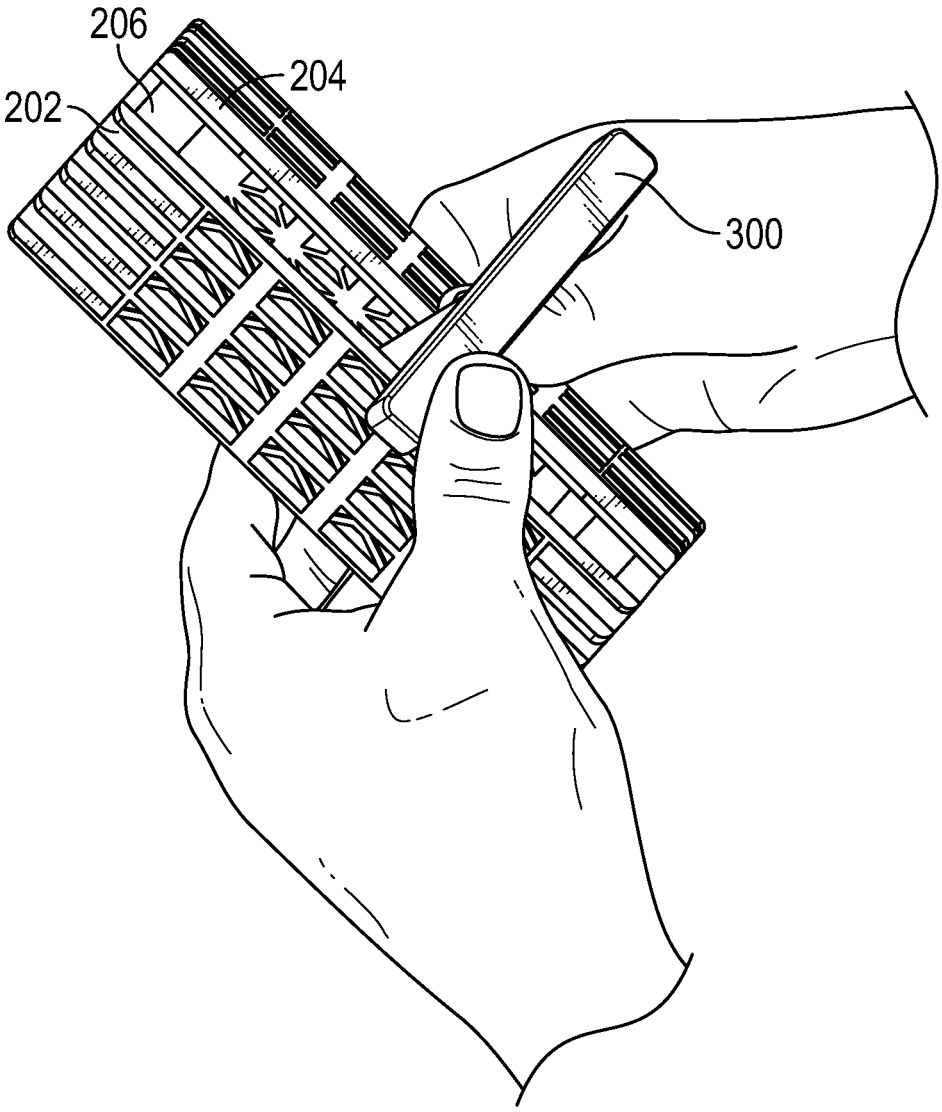

If desired, the user can pre-bend the hinges 212, as shown in FIG. 14. Here, the left and right sections 202,204 are shown rotated forward of the planar surface 208 of the middle section 206, and the face 210 of the backer plate 200.

It should be noted that the tool 300 prevents the left and right sections 202,204 from contacting one another.

Figure 15:
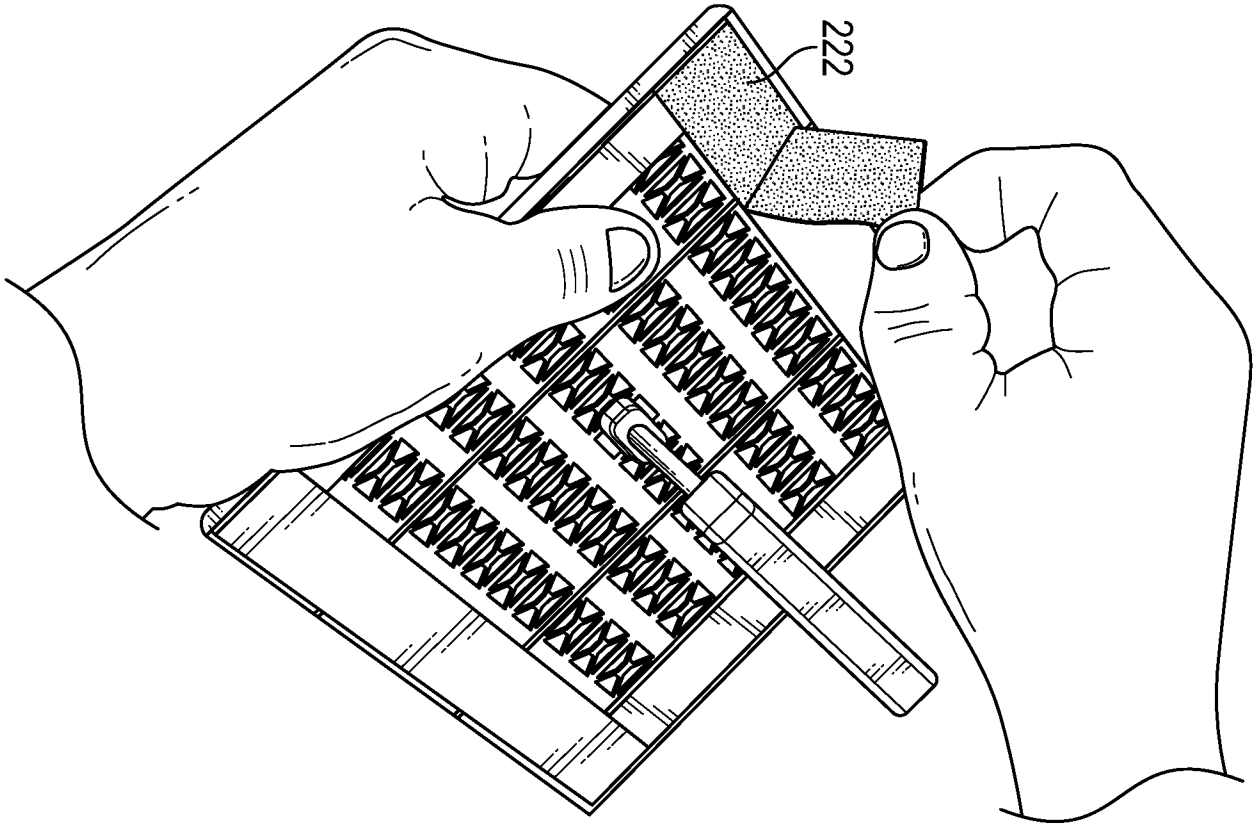
Figure 16:
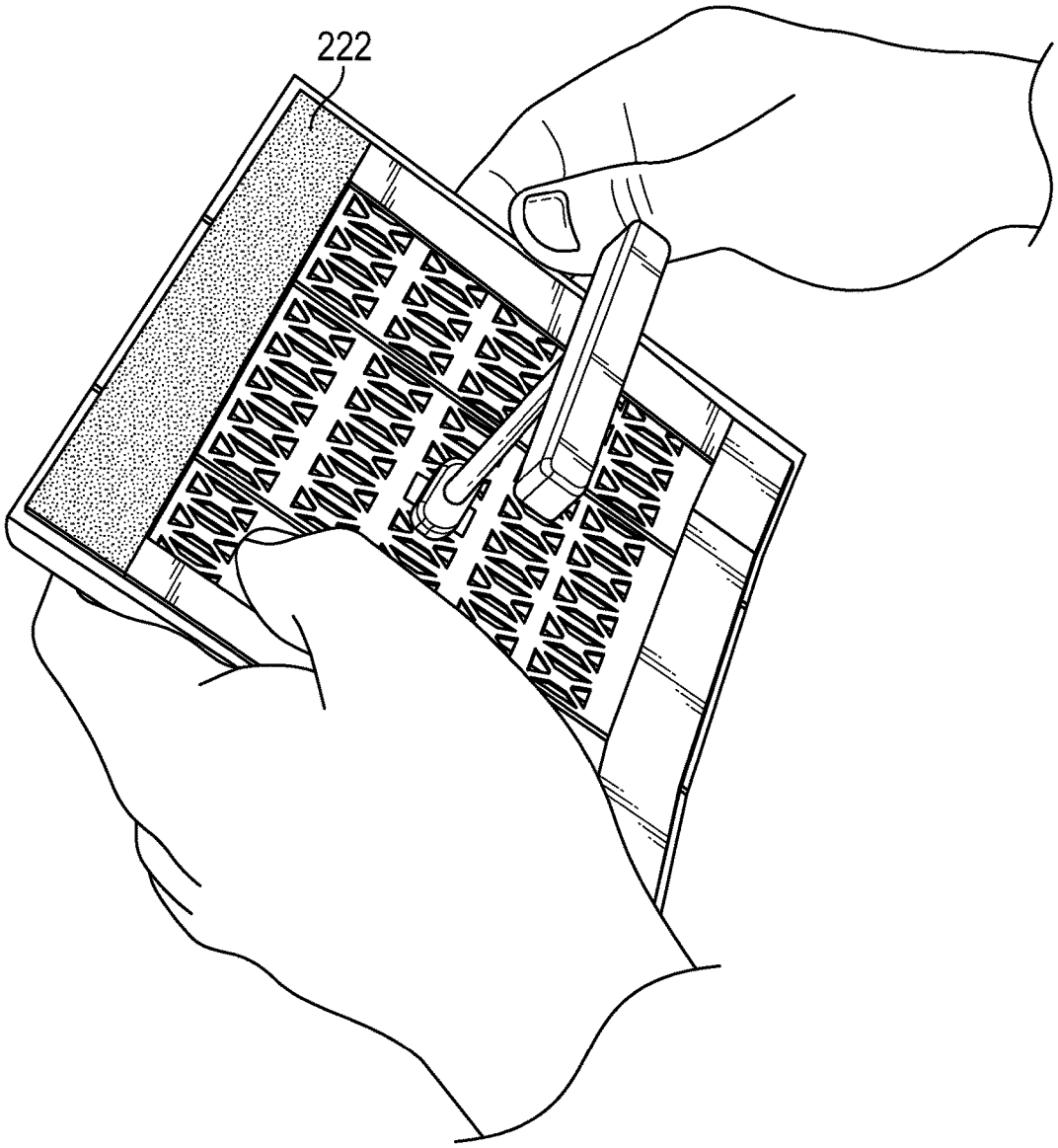

As shown in FIGS. 15 and 16, the user then prepares the adhesive 222. For example, where the adhesive comprises double sided tape, the user removes any backing from the tape, thereby exposing the adhesive 222. Alternatively, were the adhesive 222 comprises a glue, the user would apply the glue to the periphery of the face 210 of the backer plate 200.

Figure 17:
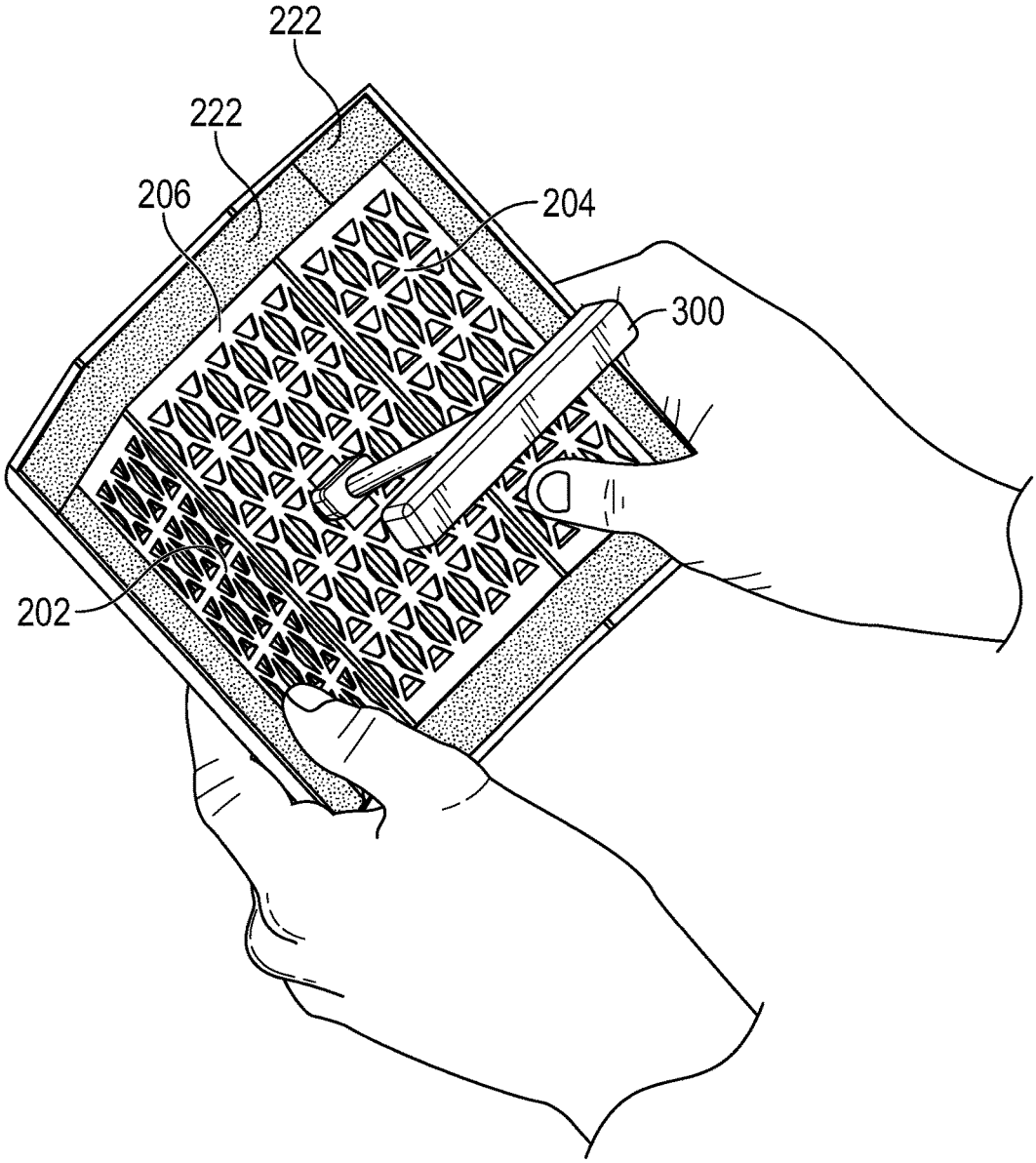
Figure 18:
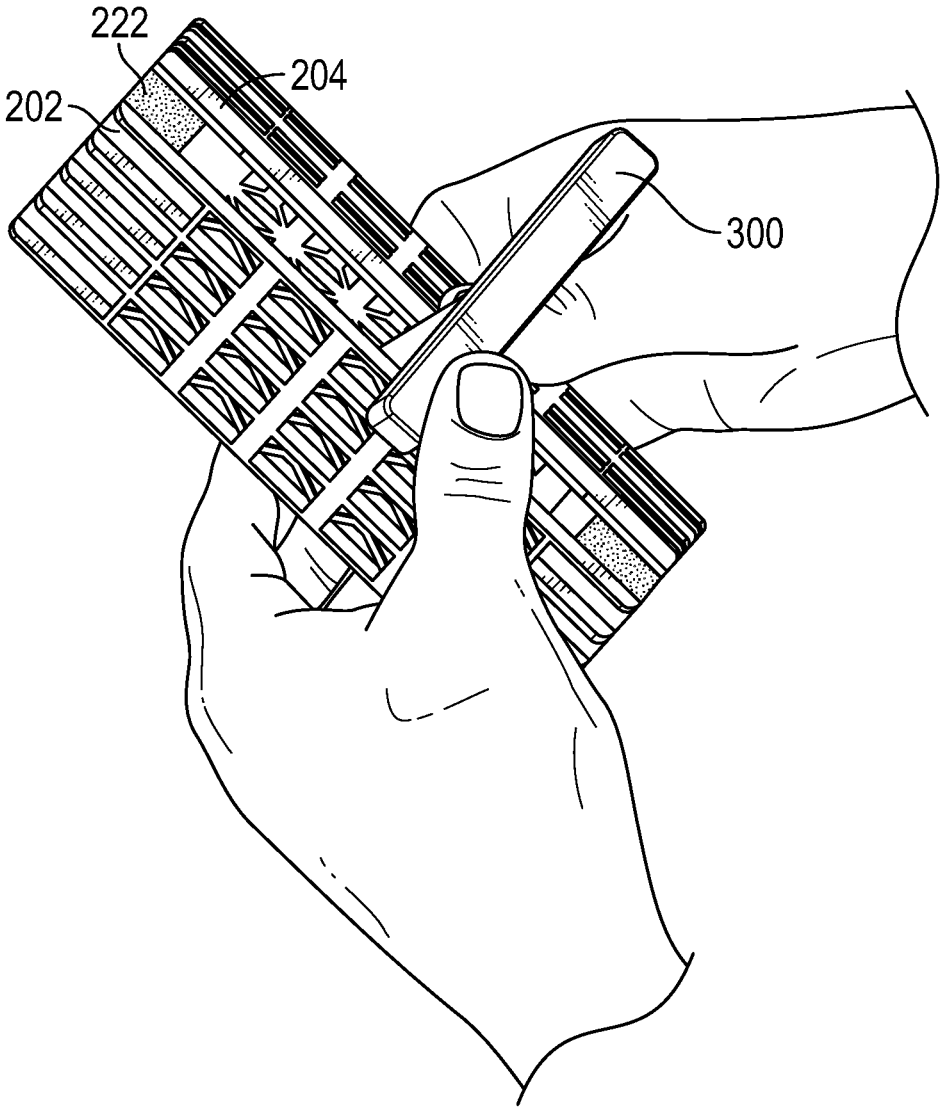

Next, as shown in FIGS. 17 and 18, the user rotates the left and right sections 202,204 forward of the planar surface 208 of the middle section 206, and the face 210 of the backer plate 200. It can be seen that the tool 300 prevents the adhesive 222 on the left section 202 from coming into contact with adhesive on either the right or middle sections 204,206. Similarly, the tool 300 prevents the adhesive 222 on the right section 204 from coming into contact with adhesive on either the left or middle sections 202,206. The adhesive 222 on the left and right sections 202,204 may contact the tool 300 itself. In this regard, the tool 300 may be molded from a polymer that resists adhesion of the adhesive 222. Alternatively, adhesion of the adhesive 222 to the tool 300 may be used to temporarily hold the apparatus 100 in the configuration shown in FIG. 18, which may be beneficial in the next step of the process.

Figure 19:
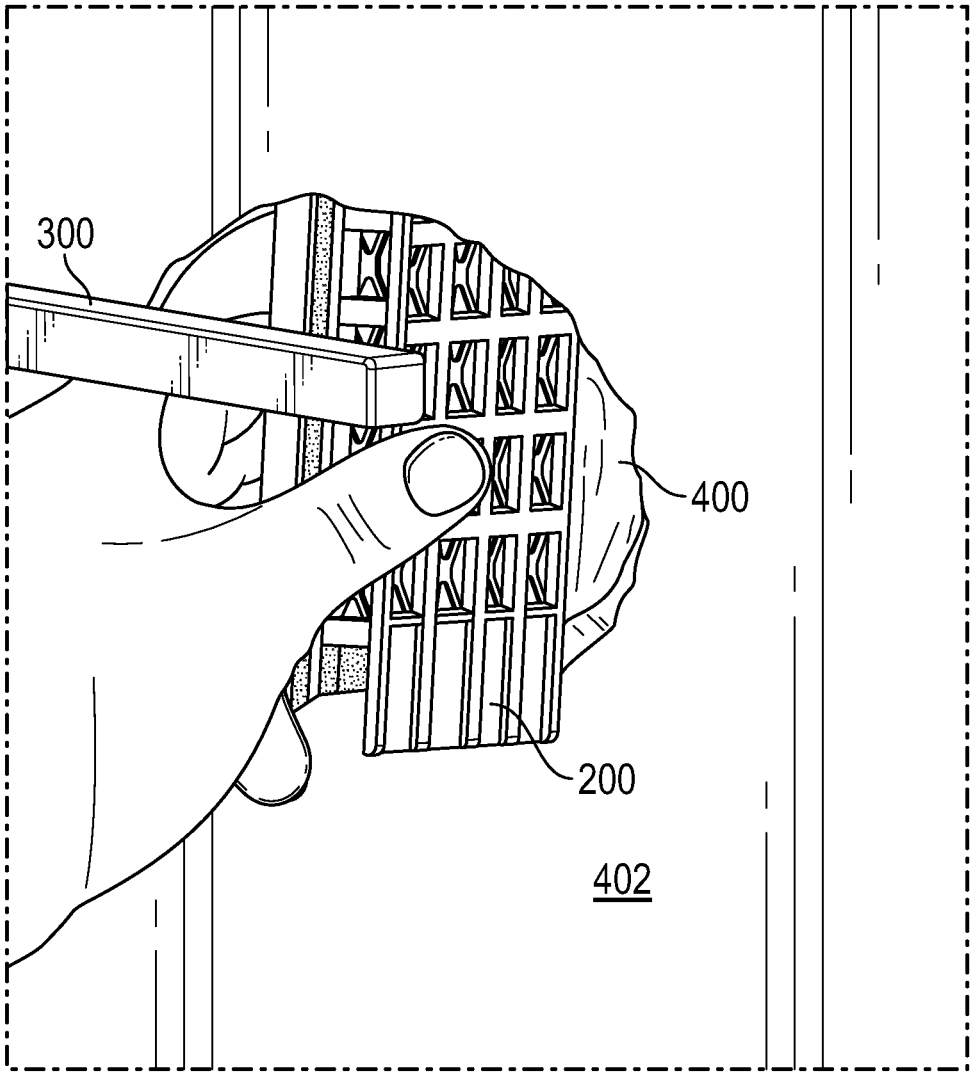
Figure 20:
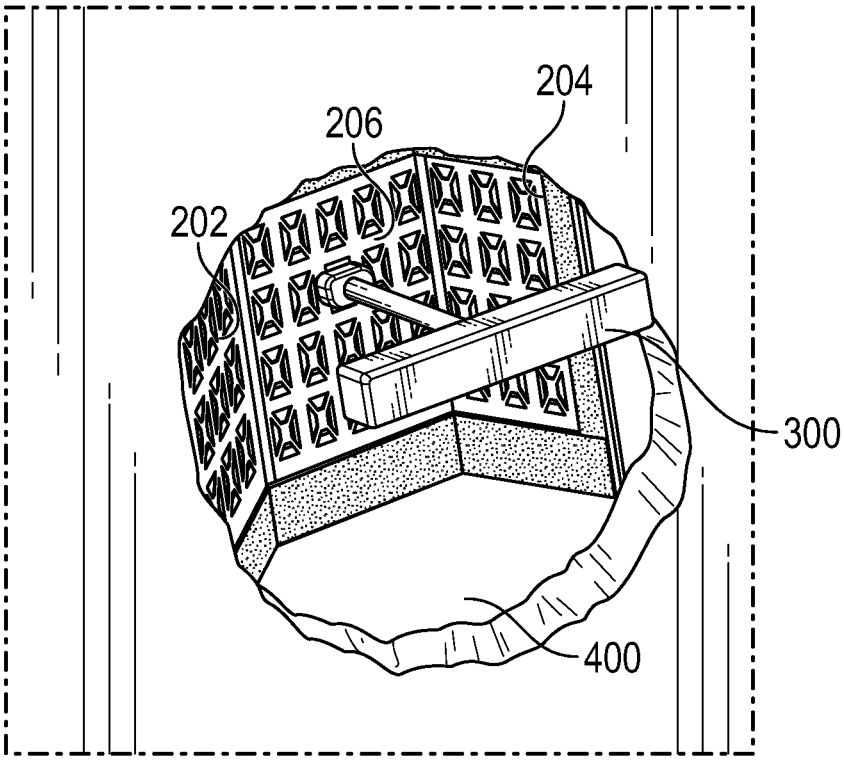

As shown in FIG. 19, with the apparatus 100 preferably held in (or near) the configuration shown in FIG. 18, the plate 200 is inserted into the hole 400 in the wall 402. Then, the left and right sections 202,204 are allowed to separate, or are separated, as shown in FIG. 20.

Figure 21:
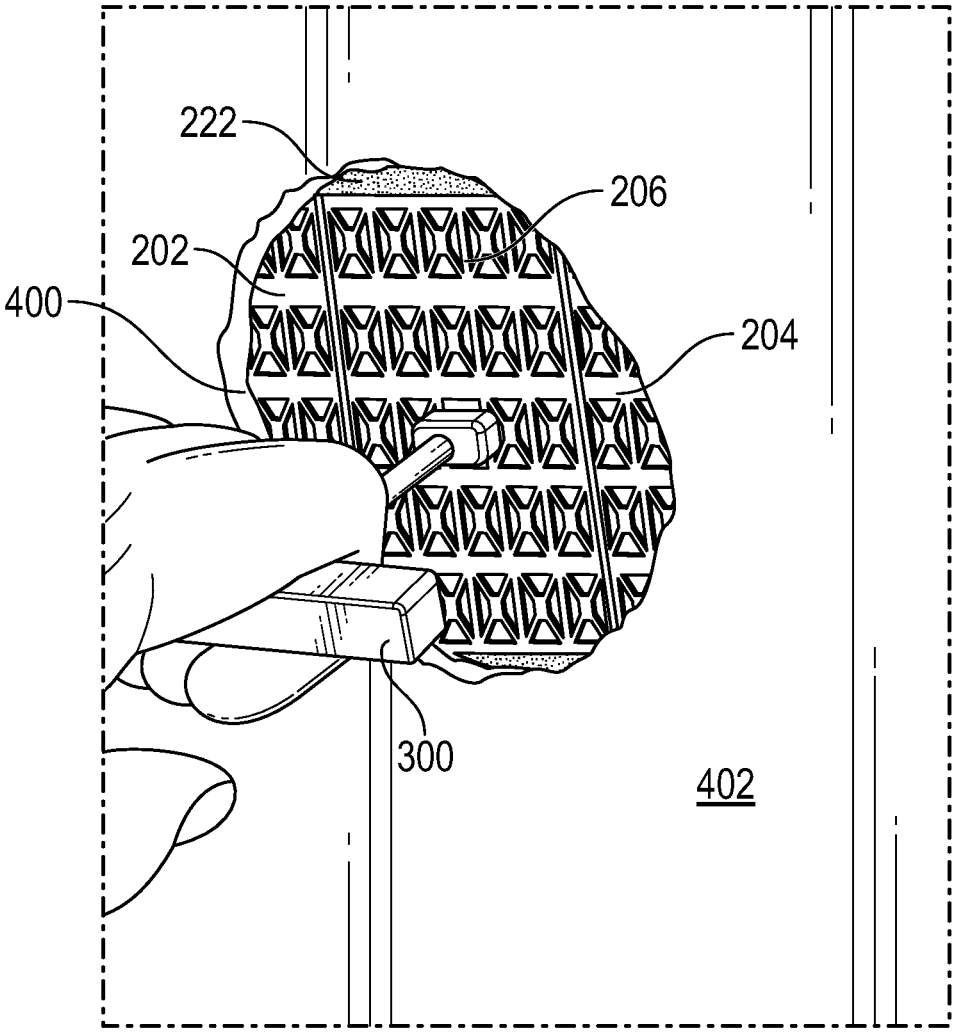

The tool 300 is then pulled away from the hole 400, as shown in FIG. 21, thereby flattening the plate 200. Specifically, as the tool 300 is then pulled away from the hole 400, the left and right sections 202,204 flatten out and align with the planar surface 208 of the middle section 206, thereby presenting the planar face 210 of the backer plate 200 to an inner surface of the wall 402. As the tool 300 is then pulled away from the hole 400, the adhesive 222 is sandwiched between the face 210 of the backer plate 200 and the inner surface of the wall 402, thereby bonding the plate 200 to the inner surface of the wall 402.

In the configuration shown in FIG. 21, the spines 214 and ribs 216 of the sections of sections 202,204,206 of the plate 200 prevent the plate 200 from flexing, thereby transferring the outward force applied to the tool 300 to the contact of the adhesive 222 with the inner surface of the wall 402. It can be appreciated that, as mentioned above, the hinges 212 prevent the left and right sections 202,204 of the plate 200 from buckling, thereby transferring the outward force applied to the tool 300 to the outer edges of the left and right sections 202,204. In this manner, the outward force applied to the tool 300 is applied to the periphery of the face 210 of the plate 200, thereby ensuring a consistent bond between the adhesive 222 and the inner surface of the wall 402 around the periphery of the face 210 of the plate 200.

To aid in ensuring a consistent bond between the adhesive 222 and the inner surface of the wall 402 around the periphery of the face 210 of the plate 200, the tool 300 joined to the plate 200 at multiple locations along the plate 200. Specifically, the user preferably rotates the tool 300 from the second orientation, wherein the tool 300 is locked within the opening, back to the first orientation (or 180 degrees from the first orientation), wherein the tool 300 may be disengaged from the plate 200. With the distal component 308 of the fitting 306 aligned with the opening 218, the user pulls on the tool 300, thereby separating the tool 300 from the plate 200. Then, the user preferably joins the tool 300 to the plate 200 by pressing the distal component 308 of the fitting 306 through another, different second opening 218 offset from the center of the face 210 of the backer plate 200, displacing the web 220 in that second opening 218. The user then rotates the tool 300 to capture the plate 200 between the distal component 308 and proximal component 310 of the fitting 306, thereby joining the tool 300 to the plate 200 at a second location along the plate 200. The user then pulls the tool 300 to apply pressure closer to the periphery of the face 210 of the plate 200.

Figure 22:
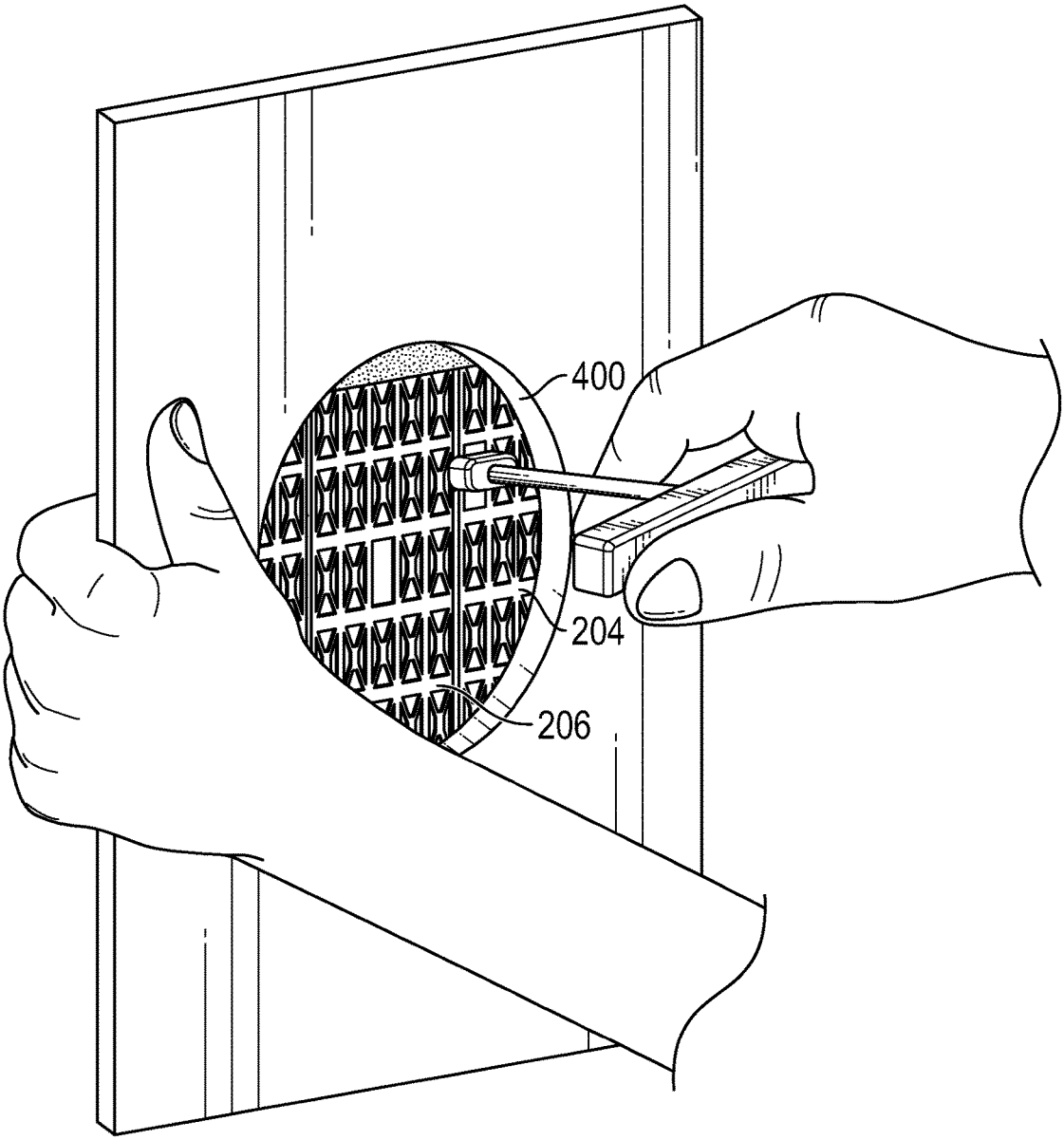
Figure 23:
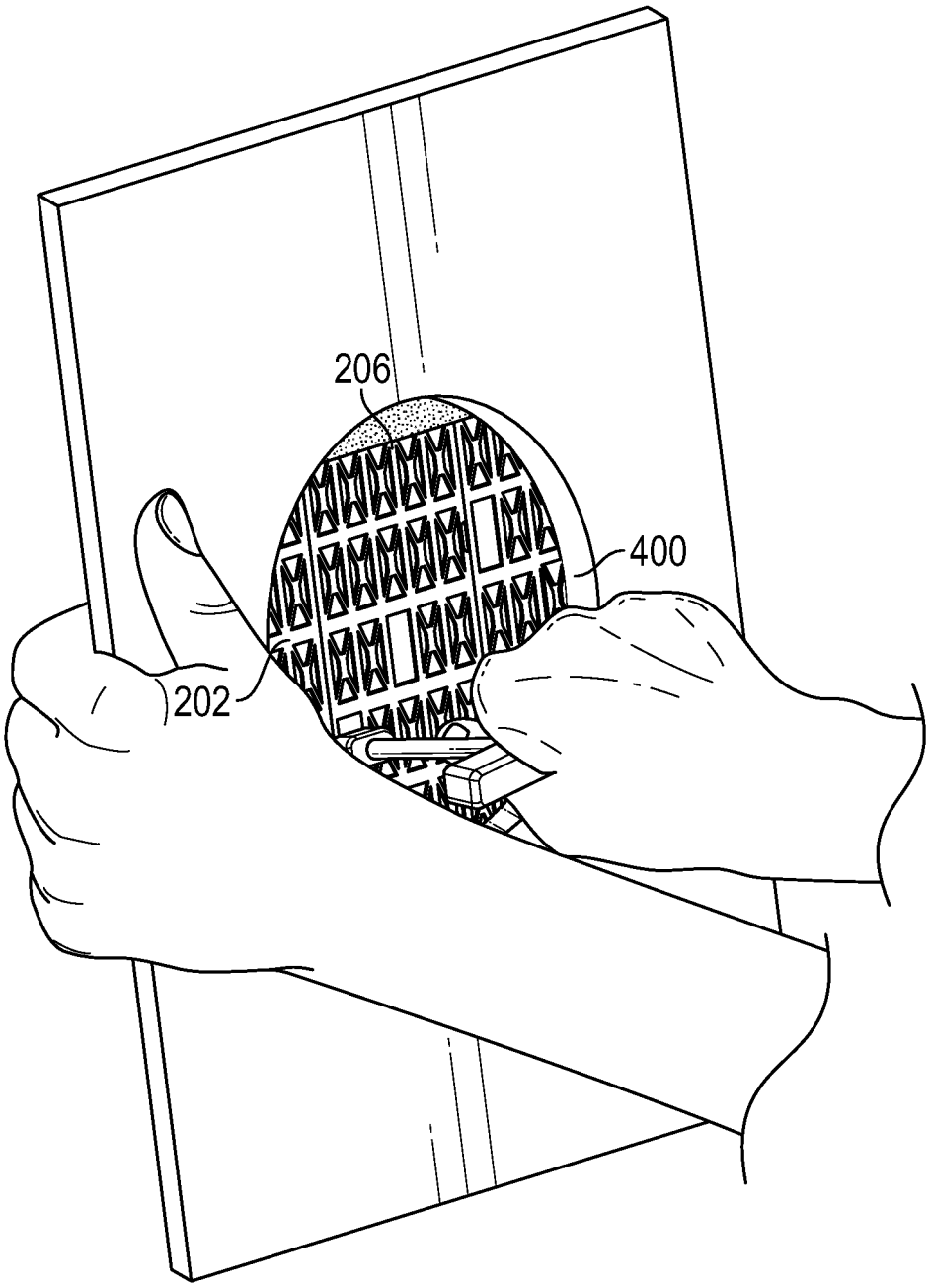

The user preferably does this, i.e. release the tool 300 from the plate 200, rejoin the tool 300 to the plate 200 at several locations around the plate 200, and then pull the face 210 of the plate 200 outward with the tool 300 thereby squeezing the adhesive between the face 210 and the inner surface of the wall, at several locations around the plate 200 in order to ensure a consistent bond between the adhesive 222 and the inner surface of the wall 402 around the periphery of the face 210 of the plate 200. For example, FIG. 22 shows the tool 300 joined to the right section 204 of the plate 200. As the user pulls the tool 300 in this location, the user is able to apply more force to the right section 204, thereby ensuring a better bond between the adhesive 222 on the right section 204 and the inner surface of the wall 402. Similarly, FIG. 23 shows the tool 300 joined to the left section 202 of the plate 200. As the user pulls the tool 300 in this location, the user is able to apply more force to the left section 202, thereby ensuring a better bond between the adhesive 222 on the left section 202 and the inner surface of the wall 402.

Figure 24:
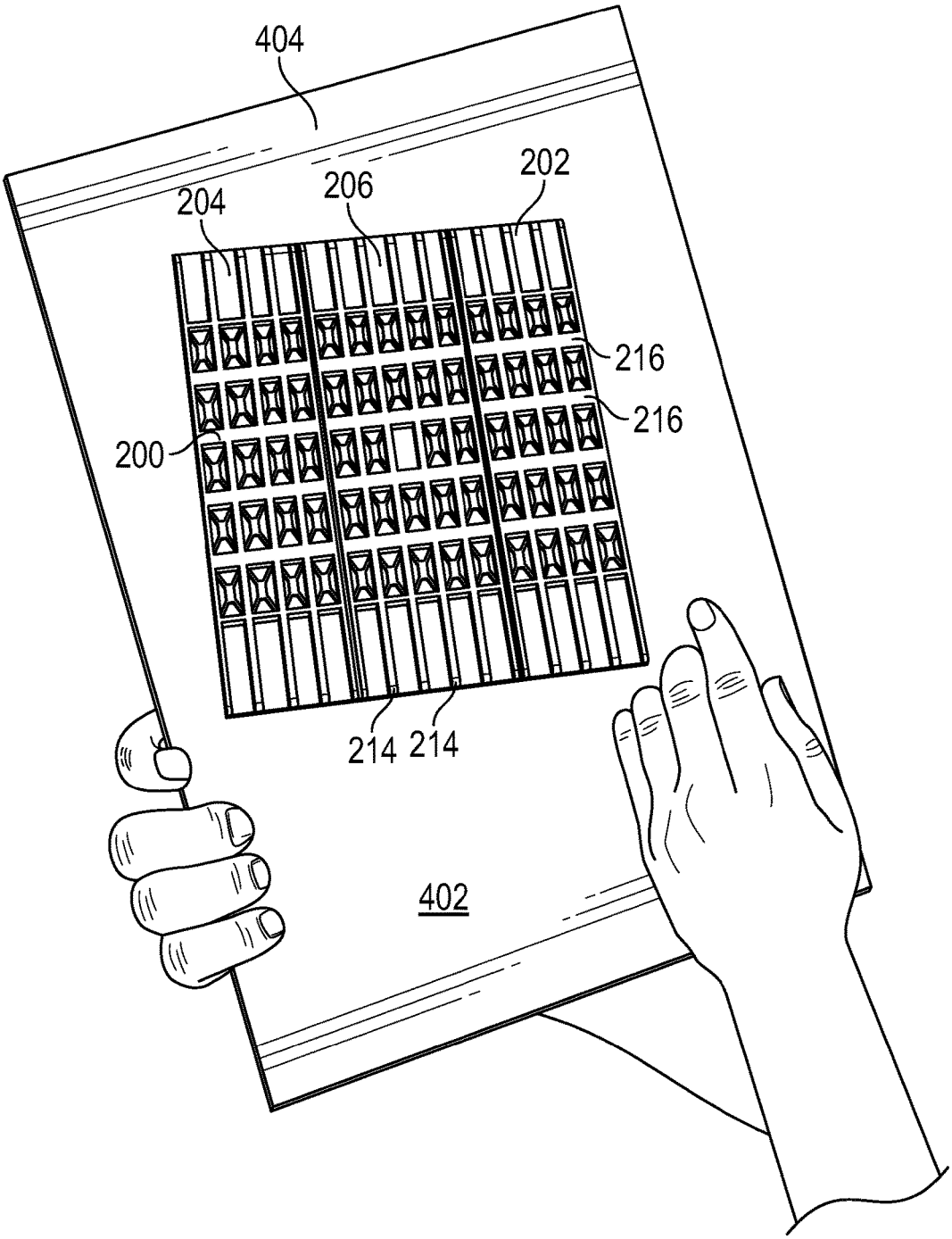

FIG. 24 shows the backing plate 200 bonded to the wall 402, covering the hole 400 in the wall 402. More specifically, FIG. 24 shows the inner surface 404 of the wall 402 with the backing plate 200 bonded thereto. It can be seen that the spines 214 and ribs 216 form a grid over the hole 400. The webs 220 that have not been displaced by the tool 300 remain, thereby providing additional structure to aid in further steps, as will be explained below.

Figure 25:
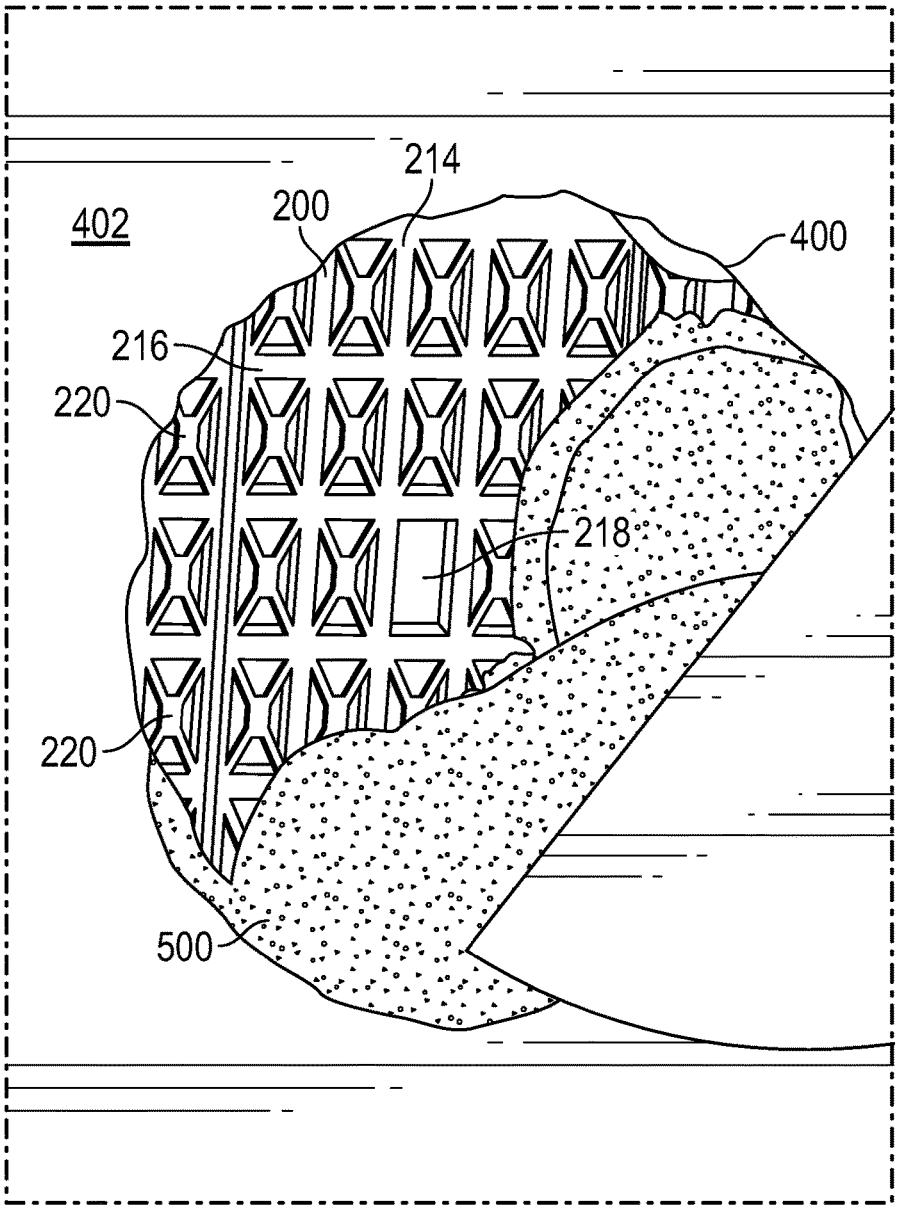
Figure 26:
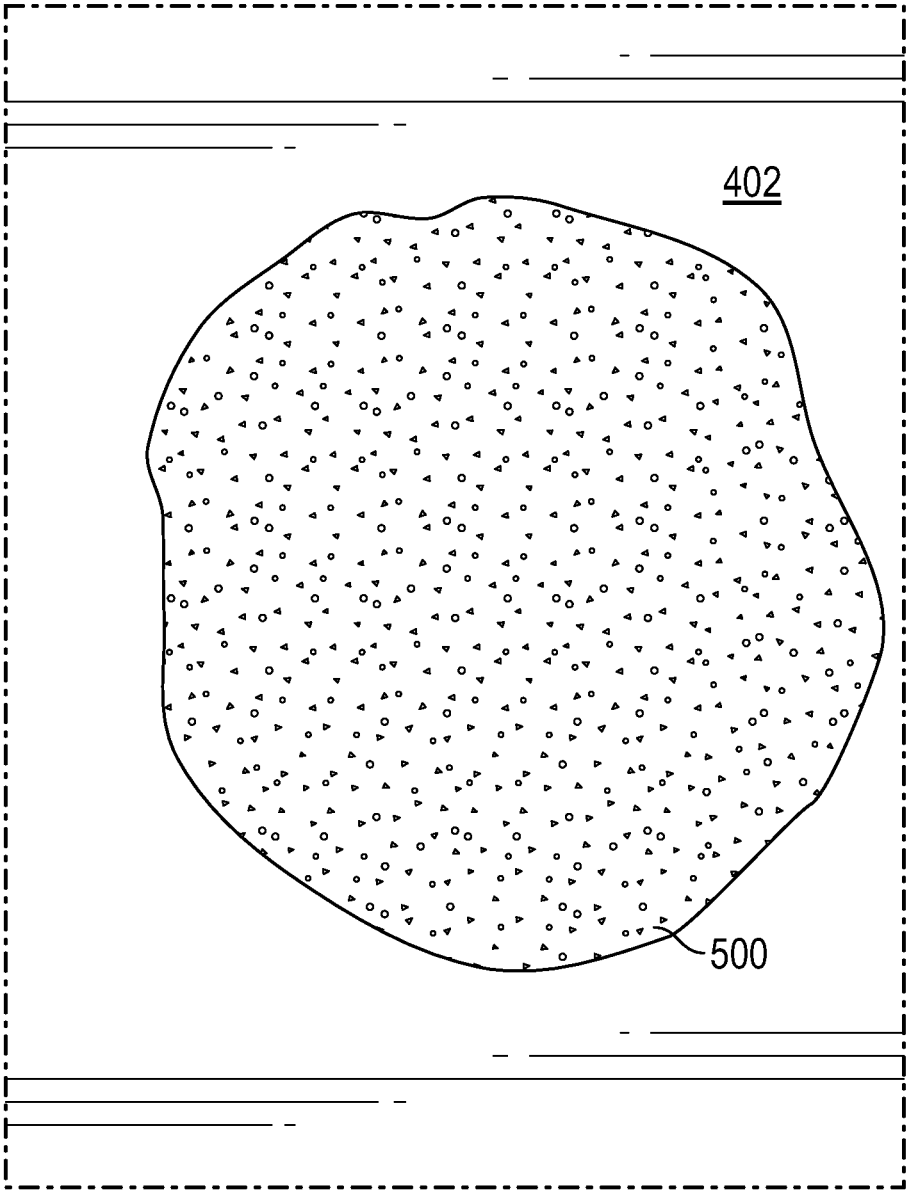
Figure 27:
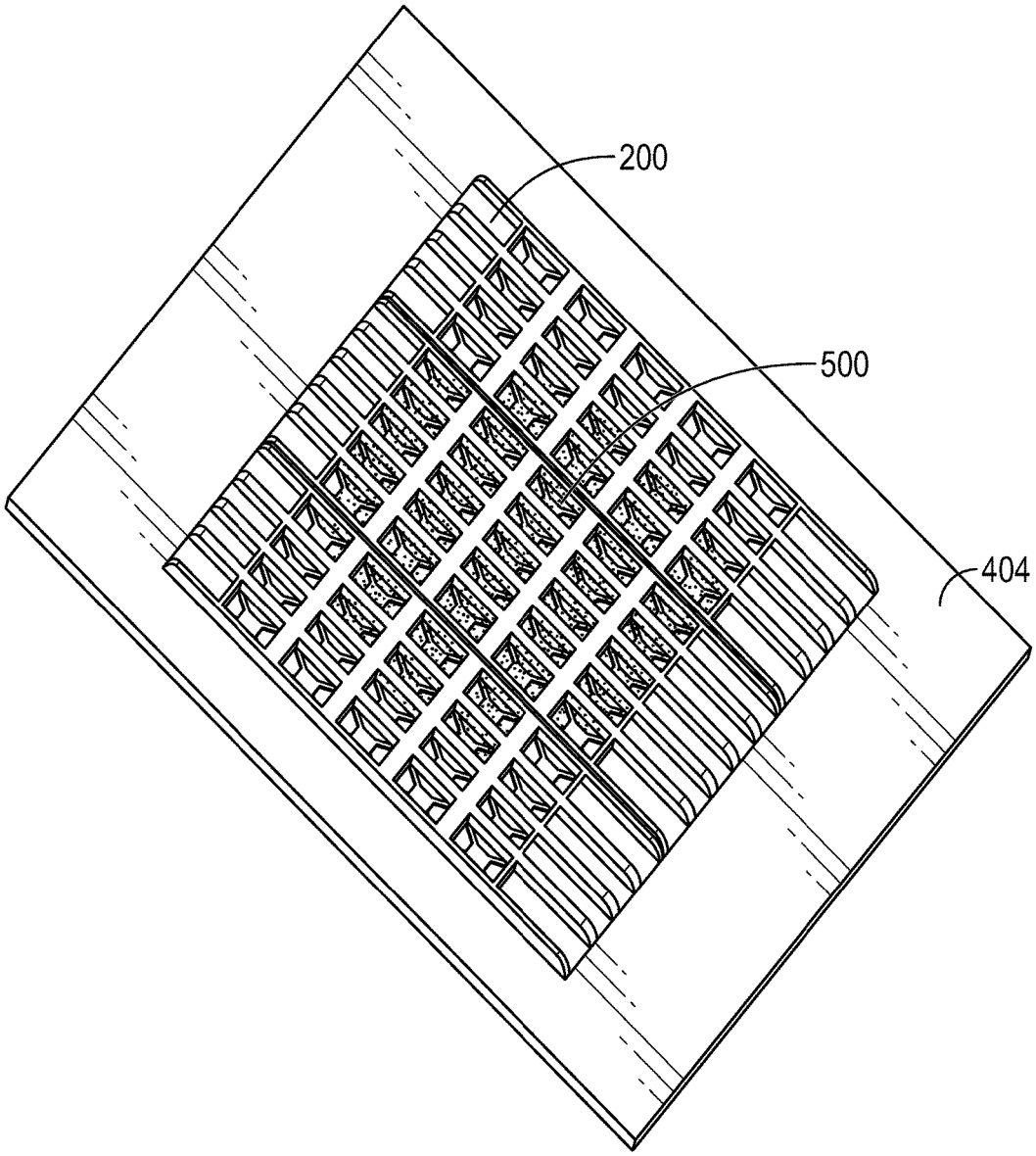
FIG. 27 shows a rear perspective view of certain aspects of the wall patch system in accordance with the present disclosure.

FIGS. 25 and 26 show the final step of filling the hole 400 with a spackle, putty, or other filler material 500. It can be seen that the spines 214, the ribs 216, and the webs 220 of the plate 200 provide backing to support the filler material 500. In fact, referring also to FIG. 27, it can be seen that some of the filler material 500 will pass through the openings 218, between the spines 214 and ribs 216, and encompass one or more of the webs 220, thereby joining and melding with the plate 200. As the filler material 500 dries and solidifies the filler material 500 fuses and forms a solid bond with the plate 200. Of course, the user may choose to paint over the filled hole, or apply some other additional treatment, as desired. In this manner, the apparatus 100 provides a system and method for supporting the filler material 500 and thereby allowing the user to easily patch a hole in a wall.

While some components may be formed integrally, others may be formed separately and otherwise coupled together, which may include the use of fasteners, such as screws, clips, brackets, adhesives, or other couplers, as will be readily understood by one of ordinary skill having the benefits of the present disclosure.

For purposes of clarity and understanding, one or more of these components may not be specifically described or shown while, nevertheless, being present in one or more embodiments of the invention, such as in a commercial embodiment, as will be readily understood by one of ordinary skill in the art.

The order of steps can occur in a variety of sequences unless otherwise specifically limited. The various steps described herein can be omitted, combined with other steps, interlineated with the stated steps, and/or split into multiple steps. Similarly, elements have been described functionally and can be embodied as separate components or can be combined into components having multiple functions. Discussion of singular elements can include plural elements and vice-versa.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range or equivalent of the following claims.

What is claimed is:

1. An apparatus for patching a hole in a wall, the apparatus comprising:

a multi-section backer plate, the backer plate comprising:
- a left section,
- a right section,
- a middle section defining a forward facing planar surface, the left, right, and middle sections together define a face co-planar with the planar surface of the middle section, and
- a first and second integrally molded hinge rotatably connecting the middle section to the left section and the right section, respectively, the hinges allowing the left and right sections to fold forward but not rearward of the planar surface of the middle section,
- each of the left, right, and middle sections comprising:
  - a plurality of substantially parallel rigid spines,
  - a plurality of substantially parallel rigid ribs, with the ribs being aligned at right angles to the spines, and
  - elongated openings between the spines and ribs, a plurality of the openings including a web therein;

an adhesive along four sides of the face of the backer plate; and a setting tool, wherein the backer plate and setting tool are configured to permit the setting tool to be selectively joined to the backer plate at multiple locations along the backer plate, the setting tool comprising:

a t-handle, and a fitting opposite the t-handle, the fitting including an elongated distal component configured to fit through the openings, displacing the web therein, in a first orientation but not in a second orientation different than the first orientation, the setting tool preventing the adhesive on the left and right sections from coming into contact with one another when the setting tool is joined to the middle section and the left and right sections are rotated forward of the planar surface of the middle section.

2. An apparatus for patching a hole in a wall, the apparatus comprising:

a multi-section backer plate, the backer plate comprising:
- a first section,
- a second section defining a forward facing planar surface, the first and second sections together define a face co-planar with the planar surface of the second section, and
- an integrally molded hinge rotatably connecting the second section to the first section, the hinge allowing the first section to fold forward but not rearward of the planar surface of the second section,
- each of the first and second sections comprising:
  - a plurality of substantially parallel rigid spines,
  - a plurality of substantially parallel rigid ribs, with the ribs being aligned across the spines,
  - openings defined between the spines and ribs, and
  - webs positioned within the openings;

an adhesive along sides of the face of the backer plate; and a setting tool, wherein the backer plate and setting tool are configured to permit the setting tool to be selectively joined to the backer plate at multiple locations along the backer plate.

3. The apparatus of claim 2, wherein the backer plate further comprises a third section coupled to the second section opposite the first section.

4. The apparatus of claim 2, wherein the spines and ribs of each section are aligned at right angles to one another.

5. The apparatus of claim 4, wherein the spines and ribs of each section are arranged in a grid.

6. The apparatus of claim 5, wherein each of the openings is elongated and rectangular.

7. The apparatus of claim 2, wherein each of the openings include one of the webs therein.

8. The apparatus of claim 7, wherein the tool comprises a fitting at one end, the fitting having an elongated distal component configured to fit through the openings, displacing the web therein, in a first orientation but not in a second orientation different than the first orientation.

9. The apparatus of claim 2, wherein the tool comprises a fitting at one end, the fitting having a distal component configured to fit through the openings in a first orientation but not in a second orientation different than the first orientation.

10. An apparatus for patching a hole in a wall, the apparatus comprising:

a multi-section backer plate, the backer plate comprising:
- a left section,
- a right section,
- a middle section, and
- first and second integrally molded hinges rotatably connecting the middle section to the left section and the right section, respectively,
- each of the left, right, and middle sections comprising:
  - a forward facing planar surface,
  - a plurality of substantially parallel rigid spines extending along and rearward from the planar surface,
  - a plurality of substantially parallel rigid ribs extending along and rearward from the planar surface, the ribs aligned across the spines,
  - openings defined between the spines and the ribs, and
  - webs positioned within the openings;
- wherein the left, right, and middle sections together define a face co-planar with the planar surface of the middle section, and the hinges allow the left and right sections to fold forward but not rearward of the planar surface of the middle section, an adhesive along sides of the face of the backer plate; and a setting tool, wherein the backer plate and setting tool are configured to permit the setting tool to be selectively joined to the backer plate at multiple locations along the backer plate.

11. The apparatus of claim 10, wherein each of the openings include one of the webs therein.

12. The apparatus of claim 11, wherein the tool comprises a fitting at one end, the fitting having an elongated distal component configured to fit through the openings, displacing the web therein, in a first orientation but not in a second orientation different than the first orientation.

13. The apparatus of claim 10, wherein the tool comprises a fitting at one end, the fitting having a distal component configured to fit through the openings in a first orientation but not in a second orientation different than the first orientation.

14. The apparatus of claim 10, wherein the spines and ribs of each section are aligned at right angles to one another.

15. The apparatus of claim 4, wherein the spines and ribs of each section are arranged in a grid.

16. The apparatus of claim 15, wherein each of the openings is elongated and rectangular.

17. The apparatus of claim 10, wherein the webs are aligned with the planar surfaces of the sections to form part of the face.

18. The apparatus of claim 17, wherein the webs are configured to allow an adhesive material applied to the face to pass into the openings.

* * * * *